United States Patent [19]

Hagy

[11] Patent Number: 4,850,541

[45] Date of Patent: Jul. 25, 1989

[54] COMMINUTION APPARATUS

[76] Inventor: John T. Hagy, 809 Alden Dr., Pittsburgh, Pa. 15220

[21] Appl. No.: 88,926

[22] Filed: Aug. 24, 1987

[51] Int. Cl.[4] ..... B02C 17/16

[52] U.S. Cl. ..... 241/171; 241/172

[58] Field of Search ..... 241/179, 171, 172, 184, 241/65, 66, 67, 101 B, 101 D, 46.02, 46.17, 97, 199.12

[56] References Cited

U.S. PATENT DOCUMENTS

| | | | |
|---|---|---|---|
| 1,135,795 | 4/1915 | Hiller . | |
| 2,016,647 | 10/1935 | McMartin . | |
| 2,297,009 | 9/1942 | Mead et al. . | |
| 2,609,151 | 9/1952 | D'Aragon | 241/171 X |
| 2,648,261 | 8/1953 | Chaplin . | |
| 2,757,909 | 8/1956 | Wayne . | |
| 2,764,359 | 9/1956 | Szegvari . | |
| 3,055,600 | 9/1962 | Barkman et al. . | |
| 3,149,789 | 9/1964 | Szegvari . | |
| 3,266,738 | 8/1966 | Goeser et al. . | |
| 3,307,792 | 3/1967 | Hughes et al. . | |
| 3,486,705 | 12/1969 | Szegvari . | |
| 3,640,476 | 2/1976 | Engels . | |
| 3,770,214 | 11/1973 | Gabor . | |
| 3,799,455 | 3/1974 | Szegvarl . | |
| 3,802,633 | 4/1974 | Schold . | |
| 3,833,178 | 9/1974 | Beck . | |
| 3,957,210 | 5/1976 | Durr . | |
| 4,044,957 | 8/1977 | Schold . | |
| 4,059,232 | 11/1977 | Engels . | |
| 4,107,792 | 8/1978 | Durr . | |
| 4,190,371 | 2/1980 | Durr et al. . | |
| 4,244,531 | 1/1981 | Szegvari . | |
| 4,496,106 | 1/1985 | Gress . | |
| 4,593,861 | 6/1986 | Blakley et al. . | |
| 4,660,776 | 4/1987 | Ikebuchi et al. . | |

FOREIGN PATENT DOCUMENTS

| | | | |
|---|---|---|---|
| 1359589 | 3/1964 | France | 241/172 |
| 1059380 | 12/1983 | U.S.S.R. | 241/172 |
| 1203773 | 9/1970 | United Kingdom | 241/172 |

*Primary Examiner*—Mark Rosenbaum

*Attorney, Agent, or Firm*—Kirkpatrick & Lockhart

[57] ABSTRACT

Apparatus is provided for the comminution of material particles dispersed in a liquid. The comminution apparatus includes a vertical cylindrical comminution vessel having a comminuting media disposed therein. A vertical agitator shaft extends into the comminution vessel and includes radially extending agitator rods at its lowermost end. A helical blade is provided on the agitator shaft to create circulation within the vortex of the comminuting media. The material may be pre-mixed with a liquid before introduction into the comminution vessel. Following comminution, the comminuted material may be removed as a slurry by a suction apparatus.

23 Claims, 3 Drawing Sheets

COMMINUTION APPARATUS

BACKGROUND OF THE INVENTION

1. Field of the Invention

The present invention relates to comminution apparatuses and, in particular, to an apparatus for comminuting particles of material in a batch processing operation.

2. Description of the Invention Background

It has been recognized that in various applications throughout modern society, it is necessary to convert particles of materials from a larger size to a relatively smaller size. For purposes of illustration throughout the instant specification, exemplary references will be made to particles of a mineral such as coal which must be reduced to a fine size. It is known that if coal particles are reduced to a mean size range of 5–40 microns, state of the art benefication apparatuses may be employed to effectively separate undesired minerals from the coal particles. The coal particles emerging from the benefication apparatus would be of such a high quality and low sulfur content that they could be used to provide a source of fuel for power generating plants.

Heretofore, no apparatus was available that was capable of efficiently and economically reducing the mean size range of coal particles of, for example, 4 mesh, to the range of 5–40 microns while eliminating virtually all oversize particles. If a process was available to economically effect such a decrease in coal particle size, much of the coal fines that are presently being discarded could be processed to provide a source of fuel for electric power plants. Also, a significant portion of the national reserves of coal which were previously unusable would be suitable for usage. The present invention provides a batch processing apparatus for reducing the size of coal particles to the desired size range by means of an improved vertical stirred wet ball mill.

The prior art contains various examples of vertical stirred wet ball mills for comminuting materials. For example, in Szegvari (U.S. Pat. No. 3,131,875), a vertical cylindrical vessel is provided having a closed bottom and an open or closed upper surface. A vertical shaft is provided concentrically within the vessel and has affixed thereto a symmetrical plurality of radially extending rods or discs. A grinding medium such as steel balls is provided within the container to a level above the uppermost rods.

In the operation of such an apparatus, the shaft is rotated thereby causing the rods to move in a circular path. A slurry comprising the material to be comminuted and water is injected into the vessel so that the slurry fills the volume of the vessel beneath and above the level of the rods. As the rods are rotated, the material particles are trapped between the rods and the balls thereby resulting in the breaking of the particles between such relatively harder materials. In addition, the movement of the rods imparts movement to the balls thereby causing them to collide with one another. As a result, any material particles disposed between the balls will be impacted by the balls and broken. Further, any particles trapped between the balls and the wall of the vessel will be similarly impacted and broken. Prior art stirred wet ball mills typically operate with agitator tip speeds in the range of 1 to 3 meters per second. Due to the use of such relatively slow speeds, the particles are comminuted by attrition, that is, the breakage of corners from the particles rather than a shattering of the particles.

Based on his study of prior art vertical stirred wet ball mills, Applicant has discovered a significant flaw in the prior art mills which has prevented them from achieving the consistently narrow range of extremely small particle sizes required to justify commercial operation of such an apparatus. Applicant's study of the dilatency of the comminuting media and the rheology of the circulating slurry provides an explanation for the problems associated with prior vertical wet stirred ball mills. As the agitating rods rotate through the comminuting media mass, the rods cause the media mass to be disrupted thereby causing its volumetric expansion within the comminution vessel. Because the media mass is constrained in all directions except upward, it must expand in that direction. As such, the media mass tends to expand upward along the vessel side wall. Due to the centrifugal forces imparted on the media mass by the rotating rods, the centrifugal moment on the media mass is toward the vessel side wall. This centrifugal moment causes the media balls to be in closest proximity to one another along the vessel side wall. The centrifugal moment thereby forces the media balls along the vessel side wall to be forced upward thereby causing a conical vortex to be formed within the center of the media mass. The effect of gravity on the media balls located at the uppermost portion of the vortex, that is, against the side wall, causes them to roll down the inner surface of the vortex in an effort to rejoin the comminuting media.

However, in order for the particles contained in the slurry to be effectively comminuted, all components of the slurry must be introduced into the vortex in the center of the comminuting media. The slurry must be introduced into the center of the comminuting media to allow all particles to pass radially outward toward the vessel wall so that such will encounter the maximum amount of comminuting media during the slurry's circulation. In addition, due to the above-described phenomenon of the comminuting media being most dense adjacent the vessel wall, the circulating media is least dense at the center of the vortex. Accordingly, less effort is required to introduce the slurry into the comminuting media in the vortex thereof.

Applicant has also noted that as comminution takes place, the viscosity of the slurry increases. This is so because there are more smaller particles of material in a given volumetric unit of slurry liquid. As those elements of slurry which have passed radially outward from the agitator shaft through the comminuting media to the outer wall of the vessel have been subjected to a complete comminution pass, the elements of slurry adjacent the chamber wall will have a relatively higher viscosity. Due to the continuous centrifugal force toward the vessel wall by virtue of the rotating agitator rods, the more viscous portion of the slurry adjacent the chamber wall will be also forced in the only unrestrained direction, namely upward. When a more viscous slurry component reaches the uppermost portion of the vortex, gravity causes the viscous slurry to be drawn downward along the upper surface of the vortex. However, Applicant has recognized that the flow of viscous slurry components toward the center of the vortex tends to prevent the less viscous and less comminuted slurry components from entering the vortex for subsequent comminution. Therefore, Applicant has discovered that the prior art vertical wet stirred ball mills tend to repeatedly recirculate the more comminuted, more viscous slurry components through the comminution process rather than introducing the less comminuted, less viscous slurry components into the vortex for comminution. Accordingly, complete comminution of the slurry cannot effectively occur. An additional problem has been discovered in connection with prior vertical wet stirred ball mills. Due to the ineffectiveness of such apparatus, they must be operated for significant lengths of time thereby generating excessive heat. Such heat must be removed by complicated and costly liquid cooling means.

In an effort to increase the throughput of comminuting apparatuses, those skilled in the art have turned to an alternative form of comminution apparatus. In such an apparatus, a horizontal comminution vessel is employed to allow the continuous processing of a slurry containing the material particles to be comminuted. A horizontal agitator shaft is supported by the closed opposing ends of the comminution apparatus and a motor drive means imparts rotary movement to the shaft. Comminution rods or discs are attached to the agitator shaft and the comminution vessel is filled with a comminution media such as steel balls.

In the operation of such a horizontal continuous stirred ball mill, the shaft is rotated at a high speed, e.g. agitator tip speeds of 7–10 meters per second, and the slurry is pumped into one end of the vessel. The comminution of the material particles takes place as the slurry travels the length of the vessel. By exposing the material particles to the violent action of the agitators and media along the length of the vessel, comminution takes place by means of shattering the particles.

It will be readily appreciated, however, that numerous difficulties are present in horizontal continuous comminuting apparatuses. Due to the inclusion of a horizontal agitator shaft, intricate seals must be provided at the ends of the vessel which have increased capital costs and have provided significant maintenance problems. Also, due to the rapid tip speeds required, the excessive heat generated must be dissipated by complicated liquid cooling means, thereby adding initial capital and maintenance expenses.

Also, it has been found that due to the high operating speeds of continuous horizontal wet ball mills, the comminution takes place due to the impact upon the particles thereby causing their shattering. However, the violent comminution occurring in continuous horizontal ball mills causes excessive wear rates of the apparatus components and media thereby requiring their frequent replacement. Also, due to the fact that any given particle is only afforded one pass through the apparatus for comminution, if a particle is not comminuted, it will exit the apparatus along with the correctly sized particles and cause problems to subsequent processes.

Applicant's invention relates to a means for improving particle circulation along the agitator shaft in order to introduce the particles into the media vortex. While circulation means along an agitator shaft have previously been provided on vertical machinery in which no comminuting media is present, such apparatus is directed to an entirely different application than Applicant's apparatus. Due to the lack of the comminuting media in such apparatus, the problems discussed above relating to the introduction of particles into the comminuting media vortex are simply not present.

The subject invention is directed toward an improved means for comminuting materials which overcomes, among others, the above-discussed shortcomings in prior art vertical stirred wet ball mills and which is effective to economically reduce the mean particle size to the required level and provide a narrow range of particle sizes. Due to Applicant's inclusion of an additional circulation means, of a form which has not been previously employed in prior art wet ball mills, the instant invention provides solutions to the problems present in prior art vertical stirred wet ball mills and provides a commercially viable apparatus.

SUMMARY OF THE INVENTION

In accordance with the present invention, there is provided apparatus for comminuting material particles. The disclosed apparatus includes a comminuting vessel mounted on a supporting framework and an agitator having a rotatable shaft that extends into the vessel.

The rotatable shaft is provided at its lowermost end with a symmetrical series of radially extending rods disposed at alternating elevations. In addition, a vertical circulating helical spiral blade is affixed to the shaft and extends from its upper region to an elevation immediately above that of the uppermost rods. Applicant has found that the addition of the helical spiral provides the circulation necessary to drastically improve the comminution process.

A comminuting media such as steel balls is provided within the vessel to a level immediately above the upper rods when such are at rest. In order to impart rotary movement to the shaft, a motor having a vertical shaft is supported on the framework. The motor is provided with a pulley assembly which drives, by means of drive belts, a pulley assembly affixed to the uppermost end of the shaft. The shaft is supported for rotary movement by means of suitable bearings.

While a slurry of liquid and the material particles to be comminuted may be introduced into the vessel by various means, such may be accomplished by an external mixing apparatus. In particular, a hopper containing the material particles may be provided vertically adjacent a feed belt. The feed belt deposits the dry particulate into a mixing chamber where the particles are mixed with a liquid carrier such as water. The slurry produced in the mixing chamber may then be introduced into the comminution vessel.

In order to remove the comminuted particles from the vessel, an arm which supports a suction means may be lowered into the vessel to a level above the level of the comminuting media at rest. The suction means may then draw off the comminuted particles in order that such may be drained from the suction means for a process use.

In the operation of the present apparatus, the material particles are fed from the hopper into the mixing chamber by means of the feed belt. Liquid is then injected into the mixing chamber to create a slurry with the particles to be comminuted. The slurry is then injected from the mixing chamber into the comminution apparatus.

The drive motor is then energized to impart rotary motion to the shaft. The material particles are then comminuted within the vessel by the interaction of the rods, the comminuting media and the vessel's walls. However, unlike prior art apparatus, the helical spiral serves to bring the lowest viscosity slurry to the best integration point, namely, at the center of the media vortex. In addition, the pressure created by the helical spiral forces the highest viscosity slurry to rise along the chamber wall to the top of the slurry before it can begin to descend. The latter mentioned action prevents the higher viscosity slurry from preventing the lower viscosity slurry from entering the media vortex. Applicant has also discovered that in the operation of the disclosed apparatus, the oversize material particles behave as media until they are comminuted into particles close in size to the mean particle size of the slurry. As such, the larger particles remain in the comminuting media until they are comminuted. As such, all slurry material may be effectively comminuted.

Following a predetermined time period, the motor is deenergized thereby halting rotation of the shaft and agitating rods. The suction apparatus is actuated to draw off the comminuted slurry material as the suction arm is lowered into the vessel to a level above that of the comminuting media. However, any oversize particles remain in the comminuting media for comminution during a subsequent comminution cycle. Following withdrawing of the comminuted slurry, the suction arm is retracted. The comminuted material may then be drained from the suction means for process use.

Accordingly, the present invention provides solutions to be aforementioned problems present with prior stirred wet ball mills. As this invention provides continuous circulation of the slurry under comminution, all material particles are repeatedly introduced into the comminuting media for comminution. As such, comminution is accomplished with levels of efficiency and economy which were previously unattained and produces a narrow range of extremely small particles.

These and other details, objects and advantages of the present invention will become apparent as the following of the present preferred embodiment thereof proceeds.

BRIEF DESCRIPTION OF THE DRAWINGS

In the accompanying drawings, I have shown a present preferred embodiment of the invention wherein.

DETAILED DESCRIPTION OF THE PREFERRED EMBODIMENTS

Figure 4:
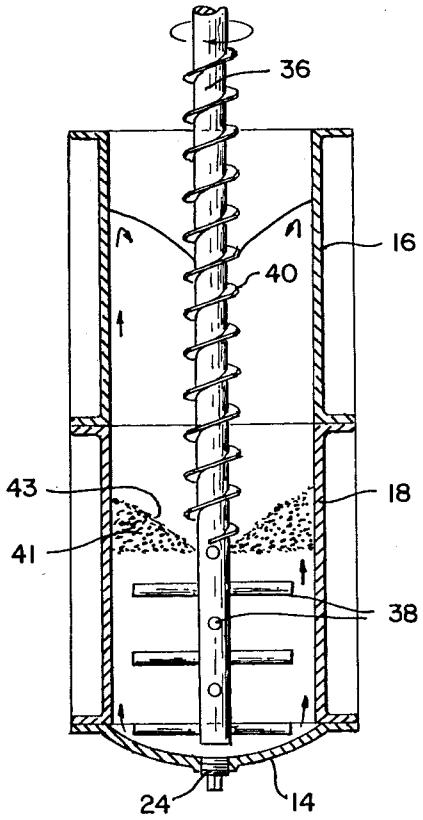
FIG. 4 is a detailed front elevation cut-away view of the comminution vessel and agitator means of the instant invention showing a rendering of the apparatus in operation.

Referring now to the drawings wherein the showings are for purposes of illustrating the present preferred embodiment of the invention only and not for purposes of limiting same, the figures show a material particle comminution apparatus generally designated as 10. It will be appreciated that comminution apparatus 10 is effective to reduce the mean particle size of various materials such as coal, wood, minerals, paints and coatings, biomass, etc. For purposes of this specification reference will be made to the comminution of coal particles.

Figure 1:
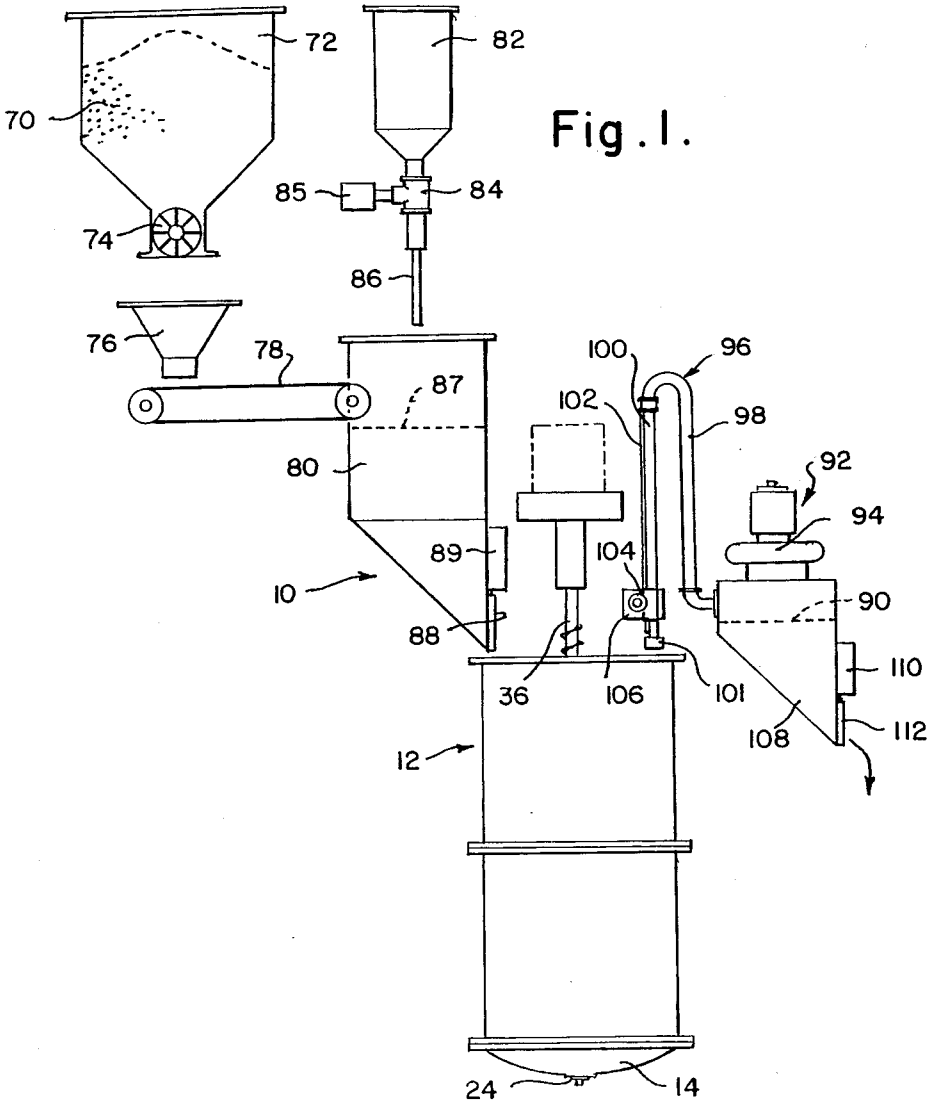
FIG. 1 is a side elevation view of the present invention.
Figure 3:
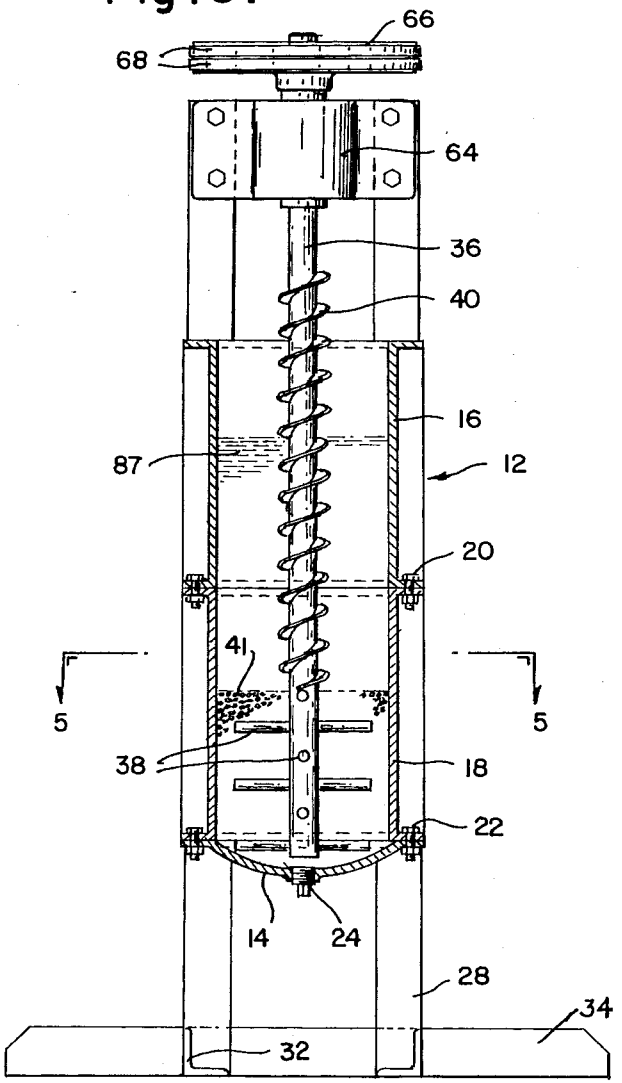
FIG. 3 is a front elevation cut-away view of the comminution vessel and agitator means of the invention.
Figure 2:
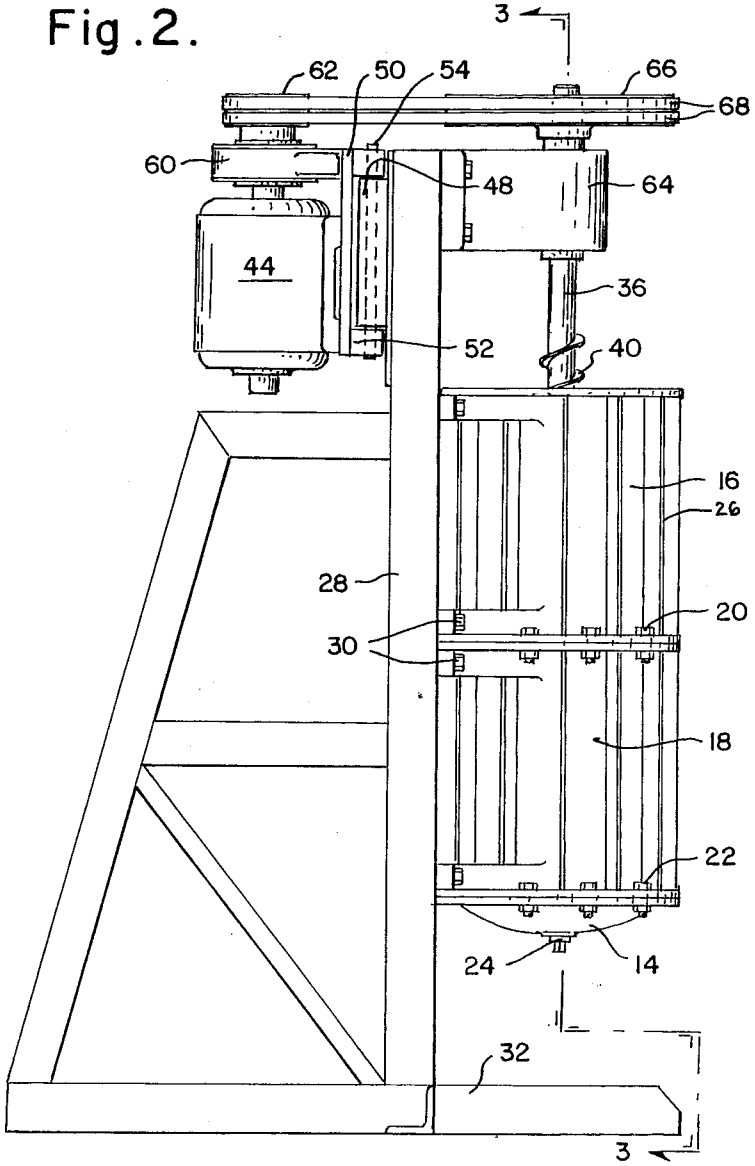
FIG. 2 is a side elevation view of the comminution vessel and agitator drive means of the present invention.
Figure 5:
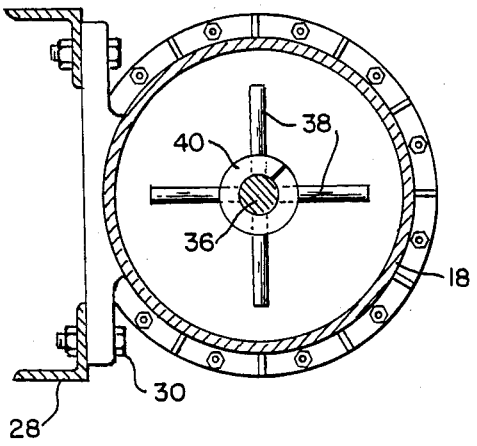
FIG. 5 is a plan sectional view of the comminution vessel and agitator means disclosed herein.
Figure 6:
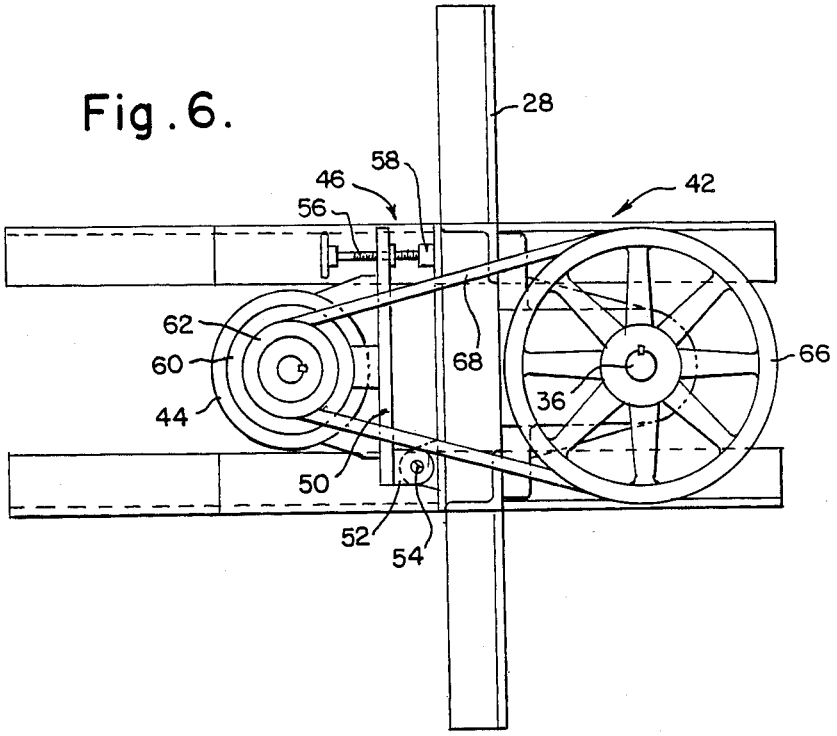
FIG. 6 is a plan view of the agitator drive means of the present invention.

More particularly and with reference to FIG. 1, there is shown a comminution apparatus 10 having a comminution vessel 12 which preferably comprises a vertical cylindrical vessel having a bottom member 14 and an open upper surface. In accordance with one embodiment of the invention, comminution vessel 12 may include an upper hollow cylindrical body 16 and a lower hollow cylindrical body 18 which are provided with mating flanges that are joined by bolts 20. Preferably, upper cylindrical body 16 may comprise a heat dissipating material such as aluminum and the lower cylindrical body 18 will comprise a more wear-resistant material such as steel. It will be appreciated, however, that comminution vessel 12 may comprise a unitary cylindrical structure having a closed or closable bottom.

In accordance with the invention, bottom member 14 will preferably comprise an internally concave member having flanges which may be attached to flanges provided on the lower portion of lower cylindrical body 18 by bolts 22. Additionally, bottom member 14 is preferably provided with a drain opening having a removable screen and which is sealable by means of a drain plug 24. As such, due to the concavity of the inner surface of bottom member 14, the vessel 12 may by drained of materials contained therein.

The comminution vessel 12 is also preferably provided with radially outwardly extending fins 26 which serve to dissipate heat generated during the comminution process. If desired, a source of draft (not shown) may be provided to provide additional convection cooling of vessel 12.

The vessel 12 is supported by means of a suitable supporting frame, generally shown as 28. The vessel 12 is supported by means of bolts 30 on frame 28 so that the vessel is disposed in a vertical orientation. Frame 28 preferably includes forwardly extending legs 32 and side legs 34 which may be secured to a suitable structure to stabilize frame 28.

An agitator shaft 36 is provided to extend vertically into vessel 12 to generate the forces needed for comminution. Agitator shaft 36 is preferably supported (by means hereinafter described) so that it does not contact vessel 12 in order to avoid disruption of the circulation currents created during the comminution process. Agitator shaft 36 is provided in its lower region with a series of radially extending agitators 38. Agitators 38 preferably comprise radially extending rods which are affixed to the agitator shaft 36. For example, each agitator 38 will preferably comprise a rod passing diametrically through agitator shaft 36. Agitators 38 are provided at discrete elevations on agitator shaft 36 and are staggered by 90 degrees. As such, agitators 38 are symmetrically disposed about agitator shaft 36. Agitators 38 are preferably formed from a wear-resistant material such as chrome steel or tungsten carbide.

Also provided on agitator shaft 38 is a vertical helical spiral blade 40. Helical spiral 40 is preferably formed from a wear-resistant material such as carbon or stainless steel and extends from agitator shaft 36 a radial distance significantly less than the length of agitators 38. In addition, helical spiral 40 preferably extends from an elevation along agitator shaft 36 above the height of the uppermost surface of upper body member 16 to a level immediately above the uppermost agitators 38. Applicant has found that by the provision of helical spiral 40, circulation within comminution vessel 12 is so improved as to markedly increase the efficiency of comminution apparatus 10. The comminution vessel 12 is then filled with a wear resistant comminuting media 41 to a level above the uppermost agitators 38. Comminuting media 41 preferably comprises steel grinding balls of a size range between 1 mm and 12 mm in diameter. Also, the level of the lowermost end of agitator shaft 36 should not be less than three (3) times the diameter of each element of the comminuting media 41 from bottom member 14.

In order to impart rotary movement to agitator shaft 36, a drive means, generally designated 42, is provided. Drive means 42 preferably includes an electric motor 44 which is mounted on frame 28 by a tension adjusting means generally shown as 46. Tension adjusting means 46 includes a first clevis 48 vertically supported on frame 28. A support plate 50 is provided with second clevises 52 in order that support plate 50 may be supported on first clevis 48 by means of pin 54 passing through first clevis 48 and second clevises 52. The position of support plate 50 relative to frame 28 may be adjusted by means of adjusting screw 56 which engages bearing plate 58. The motor 44 is in turn attached to bearing plate 50. As such, the manipulation of screw 56 varies the position of motor 44 relative to frame 28. During the operation of the present apparatus, the motor 44 is controlled so as to cause agitators 38 to have a tip speed in the range of approximately 3 to 6 meters per second. As such, the present apparatus accomplishes comminution by a combination of attrition and impact on the material particles.

The rotational output of the shaft of motor 44 is preferably input into a suitable clutch mechanism 60. Clutch mechanism 60 preferably comprises an electric clutch which, when engaged, is effective to allow motor 44 to continue to rotate while prohibiting the rotational output from clutch 60. The output from clutch 60 drives a first pulley mechanism 62.

The uppermost portion of agitator shaft 36 is supported by bearing assembly 64. Bearing assembly 64 is supported on frame 28 and preferably includes a plurality of vertical bearings effective to support agitator shaft 36 while prohibiting lateral movement thereof. Attached to the upper end of agitator shaft 36 is a second pulley assembly 66. Second pulley assembly 66 is driven by first pulley assembly 62 by means of belts 68. Accordingly, when the clutch mechanism 60 is engaged, the rotational output of motor 44 serves to drive first pulley assembly 62 which drives second pulley assembly 66 thereby rotating agitator shaft 36.

The material to be comminuted is preferably introduced into the comminution vessel 12 in the form of a liquid mixture or slurry. The material to be comminuted may be in the form of particles 70 and in the size range of approximately 4 mesh or smaller. The particles 70 are retained in a hopper 72 adjacent comminuting vessel 12 until they are to be comminuted. Hopper 72 is preferably provided with a suitable exit valving means such as a motorized star feeder 74, which serves to control and meter the discharge of particles 70 from hopper 72. The particles 70 are dispensed by star feeder 74 into a funneling means 76 which directs them onto a conveyor belt 78. Conveyor belt 78 is preferably driven by means known in the art and serves to deliver particles 70 into a mixing chamber 80.

Mixing chamber 80 is configured to receive particles 70 and also to receive a supporting liquid such as water or other suitable liquid contained within a reservoir 82. The injection of liquid from reservoir 82 into mixing chamber 80 is controlled by a suitable valve means which preferably comprises a valve 84 controlled by an electric solenoid 85. Valve 84 controls the flow of liquid into a pipeline 86 which is directed into mixing chamber 80. As such, when particles 70 are deposited in mixing chamber 80, solenoid 85 is actuated to open valve 84 to cause liquid to be input into mixing chamber 80. By this mechanism, the particles 70 are supported by the liquid in the form of a slurry 87. Mixing chamber 80 is also provided with a gate valve 88 controlled by an electric solenoid 89 which controls the release of the slurry 87 into the comminution vessel 12.

As a result of the comminution process, which is described in detail hereinbelow, the slurry containing particles 70 is converted into a slurry having particles of a mean size range of less than 20 microns. For the purposes of the instant specification, the product of comminution will be called slurry 90. In order to remove slurry 90 from the comminution vessel 12, a suction apparatus, generally designated as 92, is preferably employed. Suction apparatus 92 is supported by suitable means (not shown) adjacent to comminution vessel 12. Suction apparatus 92 includes a suction mechanism, generally designated 94, which is effective to draw slurry 90 from comminution vessel 12. The suction inlet of suction mechanism 94 is provided with a hose 96 having a flexible portion 98 and a rigid portion 100 having a screen member 101 affixed to its free end. Rigid portion 100 of hose 96 is attached to a displacement means such as a robot arm or a rack gear 102. A pinion gear 104 driven by a motor 106, is provided in engagement with a rack gear 102. Accordingly, when the motor 106 is energized, pinion gear 104 will be rotated thereby causing the movement of rack gear 102. In particular, when pinion gear 104 is rotated in a first direction, rack gear 102 causes the rigid hose 100 to be inserted into the comminution vessel 12 to a level such that screen member 101 is disposed immediately above the top of the comminuting media 41. Similarly, when motor 106 is rotated in the opposite direction, it rotates pinion gear 104 in a direction effective to cause rack gear 102 to remove rigid hose portion 100 from the comminution vessel 12. Following the withdrawal of the slurry 90 from comminution vessel 12 by means of suction apparatus 92, the slurry 90 is stored in a container 108 within suction apparatus 94. An electric solenoid 110 controls a gate valve 112 which permits or prohibits the discharge of slurry 90 from container 108.

It will be appreciated that in a preferred embodiment of the present invention, the star feeder 74, conveyor belt 78, electric solenoids 85 and 89, motor 44, clutch 60, suction apparatus 94, the motor for pinion gear 106 and electric solenoid 110 are controlled by a suitable computer or microprocessing unit.

The comminution apparatus 10 disclosed herein operates in the following manner. Prior to the initial operation of comminution apparatus 10, the comminution vessel 12 is filled with comminuting media 41 to a level above the uppermost agitator 38. The motor of the star feeder 74 is then energized to cause a predetermined amount of particles 70 to be introduced into funnel 76 for deposition onto conveyor belt 78. Conveyor belt 78 transmits the particles 70 to the mixing chamber 80. Simultaneously, electric solenoid 85 is energized to open valve 84 thereby allowing a predetermined amount of liquid from reservoir 82 to be input into mixing chamber 80 thereby forming slurry 87. Gate valve 88 is then opened by means of the actuation of electric solenoid 89. This action permits the slurry 87 containing particles 70 to be introduced into comminution vessel 12.

Motor 44 is then energized which, in the manner described above, causes the rotation of first pulley 62 thereby rotating second pulley assembly 66. The rotation of second pulley assembly 66 causes the rotation of agitator shaft 36 within comminution vessel 12. Due to the action of agitators 38, the comminuting media rotation 41 is expanded. As the greatest centrifugal forces generated by the agitators are present adjacent the inner wall of vessel 12 thereby compressing the agitating media 41 in that area and due to the fact that the only direction available for comminuting media 41 to expand is upward, the outermost elements of comminution media 41 are forced upward thereby creating a conical vortex 43 within comminuting media 41.

In order to cause circulation of all elements of the slurry through the comminuting media 41, helical spiral 40 is provided. Helical spiral 40 serves to introduce the less viscous portion of the slurry into the vortex 43 in the comminuting media 41. In addition, helical spiral 41 creates sufficient pressure into the vortex 43 in comminuting media 40 so as to cause the more viscous component of the slurry to pass to the upper region of the slurry adjacent the vessel 12 walls. As such, unlike prior art vertical wet stirred ball mills, the more viscous slurry component does not merely rise to the top of the comminuting media 41 and then pass into the vortex 43 of the comminuting media 41 thereby hindering the less viscous slurry components from entering such vortex 43 for subsequent comminution.

Following a prescribed length of time, between 5 and 20 minutes, and preferably 7 to 11 minutes, the electric clutch 60 is disengaged, thereby allowing the continued rotation of motor 44 but halting the rotation of agitator shaft 36. Motor 106 is then energized so as to cause pinion gear 104 to rotate thereby driving rack gear 102 so as to cause rigid hose section 100 to enter the slurry 90 containing the comminuted particles. Simultaneously, suction mechanism 94 is energized so as to impose a suction within hose 96. As hose section 100 is introduced into comminution vessel 12, it withdraws slurry 90 into container 108 of the suction apparatus 92. The progress of rigid hose section 100 into comminution vessel 12 is halted so that the screen member 101 of rigid hose section 100 rests immediately above the level of the comminuting media 41 while at rest. Due to the presence of screen member 101, the comminuting media 41 is not drawn into container 108. In addition, as explained above, in the present apparatus the oversize particles remain within the comminuting media 41 and are not circulated throughout the vessel 12. By virtue of the suction apparatus 92, the oversize particles are not withdrawn from the vessel 12 and remain therein for a later comminution cycle. In order to discharge the slurry 90 from container 108, solenoid 110 is energized to raise gate valve 112. Slurry 90 may thus be released from container 108 and input to a suitable receiving means to allow the use of slurry 90. However, if it was desired to remove all slurry 90 from vessel 12 the drain plug 24 may be removed and the vessel 12 drained of all slurry 90. Also, if the comminuting media 41 is to be replaced, it may be removed by removing drain plug 24.

While suction apparatus 92 is in operation, the feed of particles 70 and the mixing thereof with water in mixing chamber 80 may take place. As such, immediately following the withdrawal of hose section 100 from comminuting vessel 12 slurry 87 may be deposited thereinto. After the slurry 87 is placed in vessel 12, the clutch 60 is engaged to cause motor 44 to drive agitator shaft 36 to commence comminution of another batch of slurry 87.

EXAMPLE

Applicant has constructed an apparatus according to the present invention, the details of which follow. The comminution vessel 12 was 28 inches in height and had an inside diameter of 10 inches. The agitator shaft was 48 inches long and had 6 agitators 38 which were each 7½ inches long and ⅝ inch in diameter. The agitators were disposed on 3½ inch centers each as measured in a vertical plane. The lowermost agitator 38 was ¼ inch from the lowermost end of agitator shaft 36. The helical spiral 40 was ⅝ inch in width and ¼ inch in thickness. The agitator vessel 12 was filled with an comminuting media 41 comprising 150 pounds of 3/16 inch diameter standard steel grinding balls. The level of the steel balls extended immediately above the top of the uppermost agitator 38. Thirty-six pounds of water was inserted into comminution vessel 12 as was 24 pounds of coal of a mean size of 28 mesh by 0. The coal particles had a Hardgrove Grindability Index of 50. The motor 44 was a three-phase five (5) horsepower motor and was operated at 1800 R.P.M. and drove the agitator shaft 36 at 625 R.P.M.

The comminution apparatus 10 was operated continuously for 20 minutes and drew a maximum of 4 kilowatts. Samples were removed at various intervals. The size of the particles removed at the various intervals is shown in Table 1 below. The numbers in the columns entitled 10%, 50% and 90% indicates that 10%, 50% and 90%, respectively, of the particles were less than the sizes indicated.

TABLE 1

| Time of Comminution | 10% less than (microns) | 50% less than (microns) | 90% less than (microns) | Standard Deviation |
|---|---|---|---|---|
| 7 min. | 4.13 | 17.37 | 42.88 | 15.69 |
| 9 min. | 3.35 | 13.86 | 35.58 | 12.39 |
| 11 min. | 3.29 | 12.26 | 31.11 | 11.11 |
| 13 min. | 3.09 | 10.66 | 27.74 | 9.21 |
| 15 min. | 2.95 | 9.81 | 25.50 | 8.61 |
| 20 min. | 2.72 | 8.62 | 21.58 | 7.65 |

As is apparent from Table 1, the results of the test of the comminution apparatus 10 showed excellent results by reducing coal of a particle size of 28 mesh by 0 to a mean particle size of 13.86 microns within nine (9) minutes. Applicant submits that the results achieved by the use of his apparatus, in terms of material particle comminution, range of particle size, time to achieve a given level of comminution, and economy of operation exceed the results obtainable by prior art apparatuses.

It will be understood that various changes in the details, materials and arrangements of parts which have been herein described and illustrated in order to explain the nature of the invention may be made by those skilled in the art within the principal and scope of the invention as expressed in the appended claims.

What is claimed is:

1. Apparatus for comminuting material particles in a liquid by a batch processing operation, said apparatus comprising:

a. a vertical comminution vessel;

b. comminuting media which is contained by the comminution vessel;

c. a vertical agitator shaft extending into the comminuting media and being rotatable therein, said agitator shaft having radial agitators extending therefrom at a level thereon such that said agitators are disposed within said comminuting media, said agitators being effective upon the rotation of said shaft to cause a vortex to be formed in said comminuting media;

d. means for positively propelling particles in said comminution vessel from a level above said comminuting media into said vortex in said comminuting media so that said particles pass through said comminuting media and are circulated in said comminuting vessel above the level of said comminuting media; and e. means for rotating said agitator shaft.

2. Apparatus of claim 1 in which said means for positively propelling and circulating comprises a helical spiral attached to said agitator shaft, said helical spiral extending adjacently along said agitator shaft from a first elevation adjacent the level of the comminuting media to a second elevation.

3. Apparatus of claim 2 in which said second elevation is above the level of said particles and said liquid in said comminution vessel.

4. Apparatus of claim 1 in which the agitators comprises rods.

5. Apparatus of claim 1 in which the agitators extend from the opposite sides of said agitator shaft.

6. Apparatus of claim 1 in which said comminution vessel comprises:

a. an upper body member;

b. a lower body member; and c. a bottom member.

7. Apparatus of claim 6 in which said bottom member is concave.

8. Apparatus of claim 6 in which said upper body member comprises a heat-dissipating material.

9. Apparatus of claim 6 in which said lower body member comprises a wear-resistant material.

10. Apparatus of claim 1 in which said comminuting vessel is provided with external heat dissipating fins.

11. Apparatus of claim 1 in which said comminuting media comprises steel balls.

12. Apparatus of claim 1 further comprising means for introducing said material particles in a liquid into said comminution vessel.

13. Apparatus of claim 12 in which said means for introducing comprises:

a. a hopper for containing said material particles;

b. means for discharging said particles from said hopper;

c. a mixing chamber;

d. means for conveying particles discharged from said hopper to said mixing chamber; and e. means for injecting said liquid into said particles in said mixing chamber.

14. Apparatus of claim 1 further comprising suction means for removing the comminuted particles of said material from said comminution vessel.

15. Apparatus of claim 14 in which said suction means comprises:

a. a suction generating apparatus having a suction inlet and a reservoir for receiving comminuted particles;

b. a hose in flow comminution with the suction inlet, said hose being insertable into said comminution vessel.

16. Apparatus of claim 15 further comprising means for inserting said hose into said comminution vessel.

17. Apparatus of claim 16 in which said means for inserting comprises:

a. a rack gear attached to the free end of said hose;

b. a pinion gear in meshing engagement with said rack gear; and c. motor means for rotating said pinion gear relative to said rack gear, said motor means being rotatable in a first direction effective to cause said pinion gear to move said rack gear and the free end of said hose into said comminution vessel and in a second direction effective to cause said pinion gear to move said rack gear and said hose from said comminution vessel.

18. Apparatus of claim 1 in which said comminution vessel comprises a cylindrical body.

19. In apparatus for comminuting particulate material in a liquid slurry by a hatch processing operation which includes rotating a vertical agitator shaft having a radial agitators extending therefrom about a substantially vertical axis within a vertical comminution vessel containing comminuting media, whereby a central vortex is formed in said media, the improvement comprising:

means for positively propelling particulate material in said comminution vessel from a level above said comminuting media downwardly into said vortex so that particulate material passes through said comminuting media and is circulated in said comminution vessel above the level of said comminuting media.

20. The improvement of claim 19 in which said means for positively propelling and circulating comprises a member which is rotatable about said substantially vertical axis of said agitator.

21. The improvement of claim 20 in which said member comprises a helical blade attached to said vertical shaft.

22. The improvement of claim 21 in which the greatest dimension of said helical blade extends radially from said vertical shaft.

23. The improvement of claim 22 in which said agitator comprises:

a. a vertical shaft coaxial with said vertical axis; and b. agitator rods affixed to and radially extending from said vertical shaft.

* * * * *

UNITED STATES PATENT AND TRADEMARK OFFICE

CERTIFICATE OF CORRECTION

PATENT NO. : 4,850,541

DATED : July 25, 1989

INVENTOR(S) : John T. Hagy

It is certified that error appears in the above-identified patent and that said Letters Patent is hereby corrected as shown below:

Col. 3, line 60, cancel "no" and substitute therefor --no--.

Col. 5, line 24, cancel "be" and substitute therefor --the--. [our error]

Col. 5, line 34, following "following", insert --description--.

Col. 11, line 26, cancel "comprises" and substitute therefor --comprise--.

Col. 12, line 30, cancel "hatch" and substitute therefor --batch--.

Signed and Sealed this

Fifteenth Day of December, 1992

*Attest:*

DOUGLAS B. COMER

*Attesting Officer*

*Acting Commissioner of Patents and Trademarks*